US005355865A

United States Patent [19]

Okamura

[11] Patent Number: 5,355,865

[45] Date of Patent: Oct. 18, 1994

[54] CRANKSHAFT ANGLE SENSOR FOR AN INTERNAL COMBUSTION ENGINE

[75] Inventor: Kouichi Okamura, Himeji, Japan

[73] Assignee: Mitsubishi Denki Kabushiki Kaisha, Tokyo, Japan

[21] Appl. No.: 87,877

[22] Filed: Jul. 9, 1993

[30] Foreign Application Priority Data

Jul. 10, 1992 [JP] Japan ..... 4-183899
Jul. 10, 1992 [JP] Japan ..... 4-183900

[51] Int. Cl.[5] ..... F02P 5/00
[52] U.S. Cl. ..... 123/613; 123/647
[58] Field of Search ..... 123/146.5 A, 613, 617, 123/647

[56] References Cited

U.S. PATENT DOCUMENTS 4,343,285 8/1982 Brammer et al. ..... 123/617 X
5,028,868 7/1991 Murata et al. ..... 123/617 X
5,076,249 12/1991 Ikeuchi et al. ..... 123/613
5,165,380 11/1992 Okamura ..... 123/613

FOREIGN PATENT DOCUMENTS 27724 1/1992 Japan ..... 123/613

*Primary Examiner*—Tony M. Argenbright
*Attorney, Agent, or Firm*—Sughrue, Mion, Zinn, MacPeak & Seas

[57] ABSTRACT

A crankshaft angle sensor comprising a crankshaft angle sensing element (33) mounted to a housing (35) and a circuit board (37) mounted to the housing (35) and having an electronic circuit thereon. The electronic circuit is electrically connected to the crankshaft angle sensing element (33) for controlling an ignition timing of an internal combustion engine. The crankshaft angle sensing element (33) and the circuit board (37) are disposed in the direction substantially parallel to the axis of the distributor rotary shaft (31). The crankshaft angle sensing element (33) and the electronic circuit board (37) are electrically connected through a plurality of leads (**33*aa*, 33*bb*, 38) and insert conductors (44, 54) having a parallel-gap-welded connection portion extending in a direction substantially perpendicular to the rotary shaft (31**).

7 Claims, 3 Drawing Sheets

CRANKSHAFT ANGLE SENSOR FOR AN INTERNAL COMBUSTION ENGINE

BACKGROUND OF THE INVENTION

This invention relates to a crankshaft angle sensor for an internal combustion engine.

FIG. 5 is a sectional side view of a known crankshaft angle sensor for an internal combustion engine in which a housing 5 is made of a resin and disposed within a distributor assembly (not shown) for an internal combustion engine (not shown). The housing 5 is a substantially disc-shaped member having a central bore 5*a* through which a distributor rotary shaft 1 extends. A signal disc plate 2 is mounted to the rotary shaft 1 by means of a blank 12 and has a slit 2*a* disposed at its edge. The rotary shaft 1 is rotatably supported within the distributor assembly (not shown) and adapted to be connected to a camshaft (not shown), which is connected to an engine crankshaft (not shown), for synchronous rotation therewith.

The housing 5 also has a vertically rising portion 5*e* having a bore or a first chamber 5*b* therein which extends through the entire length of the housing 5 including the rising portion 5*e* of the housing 5. The first chamber 5*b* has an upper cavity 5*j*, a lower cavity 5*i* and a relatively narrow, reduced-diameter, comparatively long neck portion 5*f* formed at the middle portion thereof. Disposed within the neck portion 5*f* is an angle sensing element 13 hermetically attached thereto by for example a bonding agent. The angle sensing element 13 comprises a light emitter element 3 and a light detecting element 4 which faces to the light emitter element 3 for detecting a light emitted from the light emitter element 3.

A plurality of insert conductors 6 are disposed within the lower cavity 5*i* of the first chamber 5*b*. The insert conductors 6 extend vertically and downwardly, as illustrated in FIG. 5. The light emitter element 3 and the light detecting element 4 respectively have leads 3*a* and 4*a* each electrically connected by for example resistance welding method to the insert conductors 6 individually. As seen from FIG. 5, as the light emitter element 3 is remote from the insert conductors 6 separating by the light detecting element 4, the lead 3*a* of the light emitter element 3 is bent into a substantially U-shape and its one end is relatively longer than the other. The lead 3*a* passes through the upper cavity 5*j* and a through hole 5*d* which extends through the housing 5 from the upper cavity 5*j* to the lower cavity 5*i* in parallel with the neck portion 5*f* of the first chamber 5*b*. The leads 3*a* and 4*a* are connected to the insert conductors 6 by means of connection portions which extend vertically downward.

The rising portion 5*e* also has a groove 5*g* disposed in a side surface 5*h* which faces the rotary shaft 1 between the light emitter element 3 and the light detecting element 4. The disc plate 2 including a slit 2*a* rotates synchronously with the rotary shaft 1 and passes through the groove 5*g* for the purpose which will become apparent later. Hermetically attached to both opening portions of the upper cavity 5*j* and the lower cavity 5*i* of the first chamber 5*b* are covers 10 and 11 for preventing harmful gas outside from entering into the first chamber 5*b*.

As illustrated in FIG. 5, the housing 5 also has a second chamber 5*c* mounting a circuit board 7 having an electronic circuit thereon. The electronic circuit includes a power circuit portion for the light emitter element 3 and a wave-form analysis circuit portion for analyzing output signals from the light detecting element 4. The electronic circuit on the circuit board 7 is electrically connected to the light emitter element 3 and the light detecting element 4 through the insert conductors 6 disposed in the housing 5.

The circuit board 7 also has a plurality of leads 8 electrically connecting the electronic circuit thereof to outer terminals 14 disposed in the housing 5 for external connection. The leads 8 and the outer terminals 14 have connection portion which are bent and extends vertically downwardly and electrically connected each other by a resistance welding method. The height of the second chamber 5*c* of the housing 5 therefore becomes inevitably large in order to accommodate the vertically extending connection portion. The circuit board 7 is covered with a resin 15 which is for example comparatively soft silicone for preventing an ambient moisture and promoting a radiation of heat. The cover 9 is hermetically attached to an opening portion of the second chamber 5*c* for preventing harmful gas outside from entering into the second chamber 5*c*.

In the above known crankshaft angle sensor, when the rotary shaft 1 rotates synchronously with the camshaft (not shown) connected to the engine crankshaft (not shown) of the internal combustion engine (not shown), the disc plate 2 also rotates synchronously. The disc plate 2 including the slit 2*a* formed therein passes between the light emitter element 3 and the light detecting element 4 to intermittently interrupt the light beam emitted from the light emitter element 3. The light detecting element 4 detects the intermittent light beam and provides to the electronic circuit of the circuit board 7 an output signal indicative of the crankshaft rotational speed and/or position in response to the intermittent light beam. The electronic circuit of the circuit board 7 shapes a wave-form of the output signal provided by the light detecting element 4 with a comparator thereof and converts its impedance and provides a pluse signal to the outer terminal 14 through the lead 8 of the circuit board 7. As the camshaft connected to the rotary shaft 1 rotates at a fixed ratio in respect to the rotation of the engine crankshaft (not shown), a crank angle of the engine crankshaft can be detected by counting the pluse signals provided by the electronic circuit of the circuit board 37. An ignition timing of the internal combustion engine (not shown) can be therefore controlled adjustedly as is well-known in the art.

In the known crankshaft angle sensor as described above, the light emitter element 3 is remote from the insert conductors 6 because it is separated by the light detecting element 4. Further, the light emitter element 3 and the light detecting element 4 are disposed within the first chamber 5*b* and, on the other hand, the circuit board 7 is disposed within the second chamber 5*c* which is separated from the first chamber 5*b* in the radial direction of the rotary shaft 1. Therefore, the overall dimensions of the sensor are large. Connecting conductors such as the lead 3*a* of the light emitter element 3 and the insert conductors 6 should be long. The longer such connecting conductors are, the more sensitive the crankshaft angle sensor are to an outside electrical noise and there are a lot of electrical noises in the inside of the distributor assembly (not shown) and the noises are easily piled up on such long connecting conductors.

Moreover, the output impedance of the light detecting element 4 is increased with a longer lead.

Further, as the lead 3*a* of the light emitter element 3 must be bent in a complex shape such as a substantially U-shape whose one leg is longer than the other and the longer leg must be inserted into the through hole 5*d* formed in the housing 5 and electrically connected to the insert conductor 6, it is difficult to automatically assemble the crankshaft angle sensor and assembly processes are not efficient.

Also, since the first and second chambers 5*b* and 5*c* as well as the lower cavity 5*i* for accommodating the vertically extending connection portion between the lead 3*a* and the insert conductor 6 are necessary, the height of the housing 5 becomes inevitably large, so that the known crankshaft angle sensor can not be compact. Further, as the lead 3*a* of the light emitter element 3 is so long that a form of the lead 3*a* is not stable, it is difficult to securely connect the lead 3*a* to the insert conductor 6 and the connecting portion therebetween may come off. Still further, stresses caused by repeated violent temperature changes are concentrated on the connecting portion between the lead 3*a* and the insert 6. Therefore the connecting portion therebetween may be cracked and damaged easily, resulting in a poor reliability.

The long lead 3*a* is made for example of Fe-Ni alloy such as Kovar (Trade Name) plated with gold which is very expensive. The known crankshaft angle sensor is not economical.

SUMMARY OF THE INVENTION

Accordingly, one object of the present invention is to provide a crankshaft angle sensor free from the above-discussed problems of the known crankshaft angle sensor.

Another object of the present invention is to provide a crankshaft angle sensor which can be easily assembled and is simple in structure.

Another object of the present invention is to provide a crankshaft angle sensor which is compact and can be laid out well during mounting within an internal combustion engine apparatus.

Still another object of the present invention is to provide a crankshaft angle sensor whose area of the base and whose height are smaller.

Another object of the present invention is to provide a crankshaft angle sensor which can be proof against a noise and a harmful gas.

A further object of the present invention is to provide a crankshaft angle sensor which is durable in respect to a violent temperature change.

Another object of the present invention is to provide a crankshaft angle sensor which is reliable.

A still further object of the present invention is to provide a crankshaft angle sensor having an improved assembly efficiency and is inexpensive.

With the above objects in view, the crankshaft angle sensor of the present invention comprises a crankshaft angle sensing element mounted to a housing and a circuit board mounted to the housing and having an electronic circuit thereon. The electronic circuit is electrically connected to the crankshaft angle sensing element for controlling an ignition timing of an internal combustion engine. The crankshaft angle sensing element and the circuit board are disposed in the direction substantially parallel to the axis of the distributor rotary shaft.

BRIEF DESCRIPTION OF THE DRAWINGS

The present invention will become more readily apparent from the following detailed description of the preferred embodiments of the present invention taken in conjunction with the accompanying drawings, in which.

DESCRIPTION OF THE PREFERRED EMBODIMENTS

Figure 1:
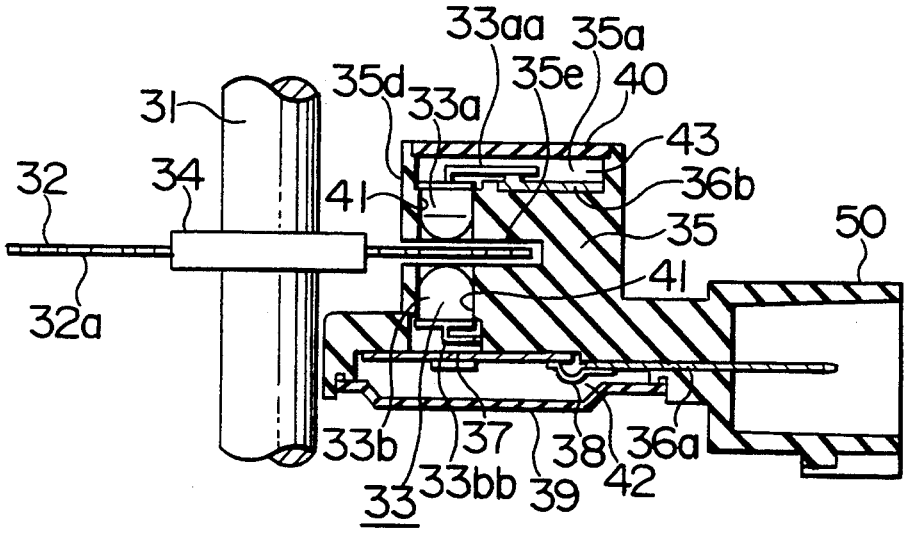
FIG. 1 is a sectional view of an embodiment of a crankshaft angle sensor of the present invention.
Figure 2:
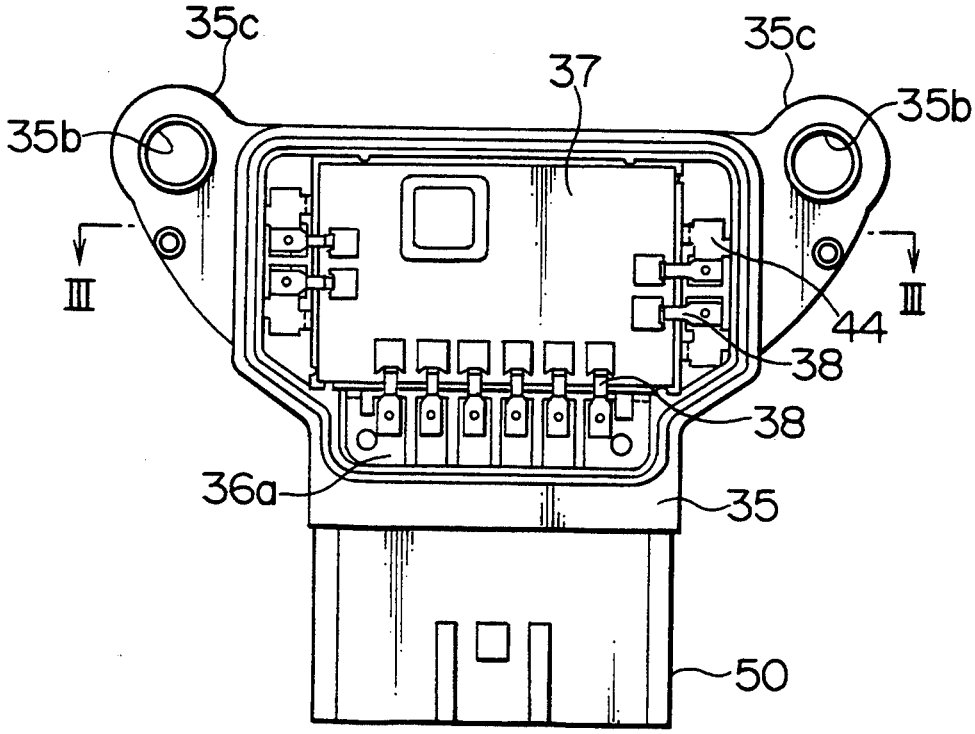
FIG. 2 is a bottom plan view of the embodiment of the crankshaft angle sensor illustrated in FIG. 1 but with the bottom cover removed for clarity.
Figure 3:
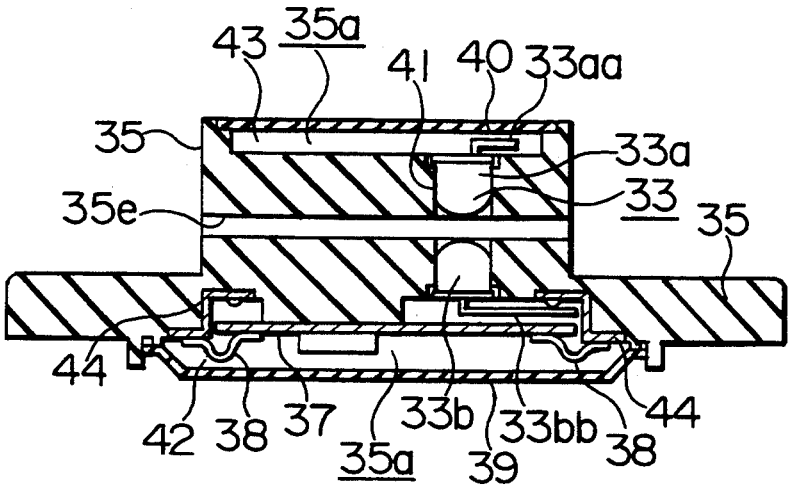
FIG. 3 is a sectional view of the embodiment of the crankshaft angle sensor taken along line III—III in FIG. 2.

FIGS. 1 to 3 illustrate one embodiment of the crankshaft angle sensor of the present invention, which comprises a housing 35 made of an electrically insulating mold resin and disposed within a distributor assembly (not shown) for an internal combustion engine (not shown). As best seen from FIG. 2 illustrating a bottom plan view of the crankshaft angle sensor but with a cover removed for clarity, the housing 35 is a substantially square-shaped member having two flanges 35*c* each having a through hole 35*b* for receiving a mounting screw (not shown). The housing 35 also has a source connector 50 extending from the side surface of the housing 35. Since the source connector 50 has an outer case made of a molded resin, the connector 50 can be integrally manufactured at the time when the housing 35 is molded.

The housing 35 has a bore or a chamber 35*a* extending therein through the entire height of the housing 35. Hermetically attached to the top and bottom of the chamber 35*a* are covers 40 and 39 made of a resin for hermetically sealing the chamber 35*a* to prevent any harmful gas from entering into the chamber 35*a*. As illustrated in FIG. 1, the sealed chamber 35*a* of the housing 35 has an upper cavity 43, the lower cavity 42 and, a relatively narrow, reduced-diameter, comparatively long neck portion 41 at the middle portion thereof. The housing 35 has a groove 35*e* formed in a side surface 35*d* across the neck portion 41 of the sealed chamber 35*a*.

Disposed within the neck portion 41 is a crankshaft angle sensing element 33 which is hermetically attached thereto by for example a bonding agent to provide a hermetic seal therebetween and hermetically seal the upper cavity 43, the lower cavity 42 and the neck portion separated by the groove 35*e*. The crankshaft angle sensing element 33 comprises a light emitter element 33*a* for emitting a light beam and a light detecting element 33*b* disposed in opposition to the light emitter element 33*a* for detecting the light beam emitted from the light emitter element 33*a*. The light emitter element 33*a* and the light detecting element 33*b* face each other and, their faces are exposed and look out on to the groove 35*e* since the groove 35*e* passes just between the elements 33*a* and 33*b* for the purpose which will become apparent later.

The light emitter element 33*a* and the light detecting element 33*b* respectively have leads 33*aa* and 33*bb*. As illustrated in FIGS. 1 and 3, the leads 33*aa* and 33*bb* are bent perpendicularly to the axis of the rotary shaft 31 (horizontally in the figures) and electrically and mechanically connected to insert conductors 36*b* (See FIG. 1) and 44 (See FIG. 3) which are disposed within the housing 35 so that one end of the insert conductors 36*b* and 44 is on the substantially same level with and connected to the ends of the leads 33*aa* and 33*bb* respectively by the resistance welding method. Thus, the connection portions between the leads 33*aa*, 33*bb* and the insert conductors 36*b*, 44 extend in a substantially perpendicular or radial direction relative to the axis of the rotary shaft 31. The insert conductor 44 is cranked so that one end thereof is on the substantially same level with the end of the lead 33*bb* and the other end thereof is on the substantially same level with one end of a lead 38 of a circuit board 37 which will be described later. During welding, two welding electrodes are disposed side by side horizontally and each extends and is connected to the lead and the insert, which should be connected each other, in the same direction. Such resistance welding method described above is called a parallel gap welding method. By using connecting portions which are perpendicular to the rotary shaft 31, the height of the housing 35 can be made smaller comparatively with the case that connection portion between the lead and the insert conductor extends in parallel to the rotary shaft 31. The reduction of the housing height is further increased by employing the above-mentioned parallel gap welding.

Vertically below the light detecting element 33*b* within the lower cavity 42 of the sealed chamber 35*a*, a circuit board 37 having an electronic circuit thereon is disposed. The electronic circuit on the circuit board 37 includes a power circuit portion for the light emitter element 33*a* and an wave-form analysis circuit portion for analyzing output signals from the light detecting element 33*b*. The electronic circuit on the circuit board 37 is electrically connected to the crank angle sensing element 33 for controlling an ignition timing of an internal combustion engine. The circuit board 37 has a plurality of leads 38 extending substantially horizontally and electrically connecting the electronic circuit thereon to the insert conductors 36*a* and 44 (FIG. 3) by the parallel gap welding method. The insert conductors or outer terminals 36*a* are disposed within and extends horizontally on the substantially same level with the leads 38 through the housing 35 from the lower cavity 42 to the inside of the outer case of the source connector 50. As described above, the insert conductors 44 are bent and cranked as illustrated in FIG. 3 and are disposed in both sides of the lower cavity 42 of the housing 35 to be connected to the leads of the circuit board 37. The circuit board 37 may be, if necessary, covered with a resin (See element 15 in FIG. 5) such as silicone for preventing the ingress of ambient moisture and promoting a radiation of heat.

As illustrated in FIG. 1, a distributor rotary shaft 31 extends vertically and is disposed close to the housing 35 and rotatably supported within the distributor assembly (not shown) in which the housing 35 is also disposed. The rotary shaft is adapted to be connected to a camshaft (not shown) which is connected to an engine shaft in synchronization with a rotation of an internal combustion engine. A signal disc plate 32 is mounted to the rotary shaft 31 by means of support means such as a blank 34. The disc plate 32 has a slit 32*a* formed at its edge. The disc plate 32 rotates together with the rotary shaft 31 and passes through the groove 35*e* between the light emitter element 33*a* and the light detecting element 33*b* of the crankshaft angle sensing element 33 to intermittently interrupt the light beam emitted from the light emitter element 33*a* and provide to the crankshaft angle sensing element 33 an information indicative of a rotation of the rotary shaft 31.

The crankshaft angle sensor of the present invention as described above operates basically in the same way as the known crankshaft angle sensor, so that the detailed explanation in relation to its operation is omitted here. As described briefly, the crankshaft angle sensor of the present invention operates in cooperation with the disc plate 32 having the slit 32*a* mounted to the rotary shaft 31. The disc plate 32 passes through the groove 35*e* between the light emitter element 33*a* and the light detecting element 33*b* to intermittently interrupt the light beam emitted from the light emitter element 33*a*. The light detecting element 33*b* detects the intermittent light beam and provides to the electronic circuit of the circuit board 37 an output signal indicative of the crank shaft rotational speed and/or position in response to the intermittent light beam detected there. Then, the electronic circuit provides a pluse signal to the outer terminal 36*a* through the leads 38 of the circuit board 37. As the camshaft (not shown) connected to the rotary shaft 31 rotates at a fixed ratio in respect to the rotation of the engine crank shaft (not shown), a crank angle of the engine crank shaft can be detected from counting the pluse signal provided by the electronic circuit. An ignition timing of the internal combustion engine can be therefore controlled adjustedly.

Figure 4:
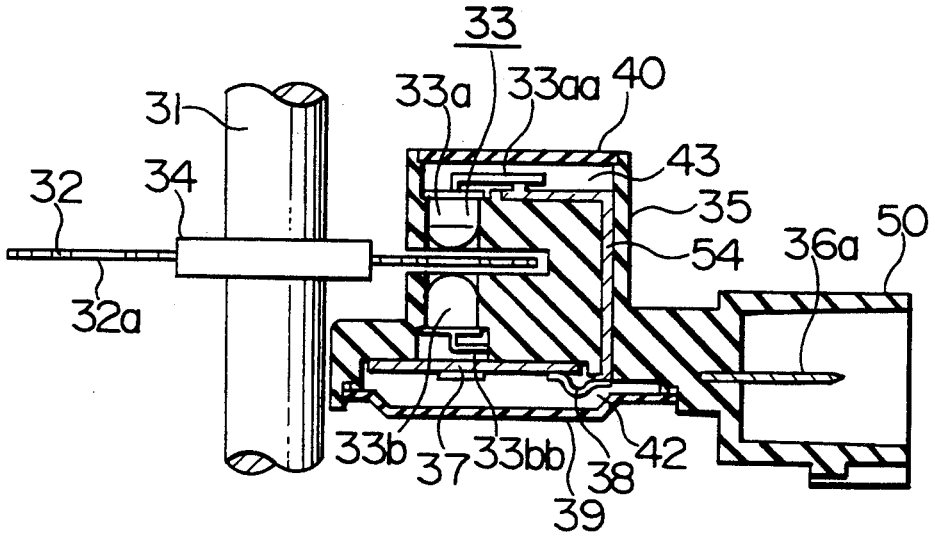
FIG. 4 is a sectional view of another embodiment of a crankshaft angle sensor of the present invention.

FIG. 4 illustrates another embodiment of the crankshaft angle sensor of the present invention, which has basically the same structure as that illustrated in FIG. 1 but is different in that a substantially U-shaped insert conductor 54 extends from the upper cavity 43 to the lower cavity 42 within the housing 35 and electrically connects the lead 33*aa* of the light emitter element 33*a* to the lead 38 of the circuit board 37. As illustrated in FIG. 4, the insert conductor 54 is formed within the housing 35 so that one end thereof is on the substantially same level with the lead 33*aa* of the light emitter element 33*a*, which is bent horizontally (perpendicularly to the rotary shaft) in the same way as the above embodiment illustrated in FIG. 1, and the other end thereof is on the substantially same level with the lead 38 of the circuit board 37. The lead 33*aa* of the light emitter element 33*a* and the lead 38 of the circuit board 37 are respectively electrically and mechanically connected to each of the ends of the U-shaped insert conductor 44 by using the parallel gap welding method of the resistance welding method. Further, the lead 33*bb* of the light detecting element 33*b* is electrically and mechanically connected to the electronic circuit on the circuit board 37 through an insert conductor (not shown) disposed within the housing 35 by the parallel gap welding method similarly to that illustrated in FIG. 3, if necessary, the cranked insert conductor like 44 in FIG. 3 may be used.

In the embodiments of the crankshaft angle sensor of the present invention as described above, since the light emitter element 33*a*, the light detecting element 33*b* and the circuit board 37 are disposed within the same chamber 35*a* of the housing 35 and arranged along an axis parallel to the rotary shaft 31, an horizontal area of the base of the housing 35 is very small and the structure in the housing 35 is simple.

Since the connection portions between the leads and the insert conductors extend perpendicularly to the rotary shaft 31, the height of the housing can be made small.

Further, since each one end of the leads **33*aa* and 33*bb* of the light emitter element 33*a* and the light detecting element 33*b* is disposed to be on the same level with the insert conductors 36*b* (See FIG. 1), 54 (See FIG. 4) and 44 (See FIG. 3) and the lead 38 of the circuit board 37 is disposed to be on the same level with the insert conductors 36*a*, 44 and 54, they are welded respectively on the same level by the parallel gap welding method. The height of these elements connected each other becomes lower and the height of the housing 35 therefore becomes smaller. The area of the base and the height of the housing 35** becomes smaller and compact, it can be laid out efficiently and beautifully within the distributor assembly (not shown).

As the covers 39 and 40 are hermetically attached to the opening portions of the housing 35 and, the light emitter element **33*a*, and the light detecting element 33*b* are also hermetically attached to the neck portion of the chamber 35*a*, the upper cavity 43 and the lower cavity 42** are both hermetically sealed completely. Therefore, the elements disposed within the inside thereof are protected from any harmful gas outside.

The lead **33*aa* of the light emitter element 33*a* has only to be bent horizontally by one portion like a L-shape, a lead-forming process of the lead 33*aa* therefore becomes very easy and simplified. Further, as the lead 33*aa* becomes shorter, the shape of the lead 33*aa* is therefore stable and it is easy to securely and correctly connect the lead 33*aa* to the insert conductor 36*b* (See FIG. 1) or 54 (See FIG. 4). The connecting portion thereof can not be damaged. The reliability becomes good and the assembly process becomes efficient. Still further, as the lead 33*aa* is made of an expensive Kover, the reduced length of the lead 33*aa*** can cut down costs.

Figure 5:
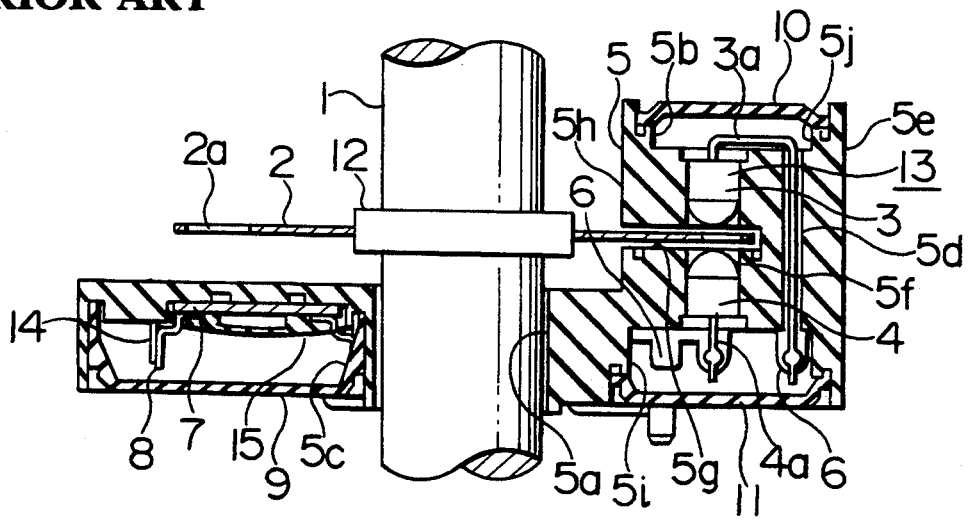
FIG. 5 PRIOR ART
FIG. 5 is a sectional view of a known crankshaft angle sensor.

Since the light emitter element **33*a* and the light detecting element 33*b* are electrically connected to the circuit board 37 respectively through the insert conductors 54 (See FIG. 4) and 44 (See FIG. 3), stresses which are caused by a repeated violent temperature change outside can be prevented from concentrating on connecting portions comparatively with the case that the known long lead 3*a* in FIG. 5 extending through the through hole 5*d*** is used. Solder crackings at the connecting portions do not occur. Durableness in respect to a repeated violent temperature change outside can be gained.

As the light detecting element **33*b* and the circuit board are disposed close by each other within the same cavity 42, the insert conductor 44 which connects therebetween electrically can be very short. Undesirable external noises do not pile on the insert conductor 44**. The crankshaft angle sensor of the present invention also can be proof against external noises.

What is claimed is:

1. A crankshaft angle sensor for use in a distributor assembly and which operates in cooperation with a perforated signal disc plate mounted to a distributer rotary shaft comprising:

a housing;

a crankshaft angle sensing element mounted to said housing; and a circuit board mounting to said housing and having an electronic circuit thereon, said electronic circuit electrically connected to said crankshaft angle sensing element for controlling an ignition timing of an internal combustion engine;

said crankshaft angle sensing element and said circuit board being disposed in a direction substantially parallel to the axis of the distributor rotary shaft and each being connected through a plurality of conductors having a connection portion extending in a direction substantially perpendicular to said rotary shaft.

2. A crankshaft angle sensor as claimed in claim 1, wherein said crankshaft angle sensing element is electrically connected to said circuit board through said conductors by parallel gap welding.

3. A crankshaft angle sensor for use in a distributor assembly and which operates in cooperation with a perforated signal disc plate mounted to a distributor rotary shaft comprising:

a housing:

a crankshaft angle sensing element mounted to said housing wherein said crankshaft sensing element comprises a light emitter element for emitting a light beam and a light detecting element disposed facing said light emitter element for detecting said light beam emitted from said light emitter element; and a circuit board mounted to said housing and having an electronic circuit thereon, said electronic circuit electrically connected to said crankshaft angle sensing element for controlling an ignition timing of an internal combustion engine;

said crankshaft angle sensing element and said circuit board being disposed in a direction substantially parallel to the axis of the distributor rotary shaft;

said light detecting element said circuit board are electrically connected through a relatively rigid insert conductor disposed to said housing and having a connection portion extending in a direction substantially perpendicular to said rotary shaft.

4. A crankshaft angle sensor as claimed in claim 3, wherein said light detecting element is electrically connected to said circuit board through said insert conductor by parallel gap welding.

5. A crankshaft angle sensor for use in a distributor assembly and which operates in cooperation with a perforated signal disc plate mounted to a distributor rotary shaft comprising:

a housing;

a crankshaft angle sensing element mounted to said housing wherein said crankshaft sensing element comprises a light emitter element for emitting a light beam and a light detecting element disposed facing said light emitter element for detecting said light beam emitted from said light emitter element; and a circuit board mounted to said housing and having an electronic circuit thereon, said electronic circuit electrically connected to said crankshaft angle sensing element for controlling an ignition timing of an internal combustion engine;

said crankshaft angle sensing element and said circuit board being disposed in a direction substantially parallel to the axis of the distributor rotary shaft;

said light emitter element and said circuit board are electrically connected through a relatively rigid insert conductor disposed to said housing and having a connection portion extending in a direction substantially perpendicular to said rotary shaft.

6. A crankshaft angle sensor as claimed in claim 5, wherein said light emitter element is electrically connected to said circuit board through said insert conductor by parallel gap welding.

7. A crankshaft angle sensor for use in a distributor assembly and which operates in cooperation with a perforated signal disc plate mounted to a distributor rotary shaft comprising:

a housing;

a crankshaft angle sensing element mounted to said housing; and a circuit board mounted to said housing and having an electronic circuit thereon, said electronic circuit electrically connected to said crankshaft angle sensing element for controlling an ignition timing of an internal combustion engine;

said crankshaft angle sensing element and said circuit board being connected through a plurality of conductors having a connection portion extending in a direction substantially perpendicular to said rotary shaft.

* * * * *